United States Patent [19]

Kanzaka

[11] 4,224,730

[45] Sep. 30, 1980

[54] METHOD AND APPARATUS FOR REMOVING FASTENER ELEMENTS FROM A SLIDE FASTENER CHAIN

[75] Inventor: Yoshihiro Kanzaka, Nyuzen, Japan

[73] Assignee: Yoshida Kogyo K.K., Tokyo, Japan

[21] Appl. No.: 24,006

[22] Filed: Mar. 26, 1979

[30] Foreign Application Priority Data

Jul. 12, 1978 [JP] Japan ..... 53/84905

[51] Int. Cl.[3] ..... B21D 53/50; B23P 19/04; B29D 5/00

[52] U.S. Cl. ..... 29/408; 29/770; 83/921

[58] Field of Search ..... 29/33.2, 408, 410, 426, 29/427, 766, 770; 83/921

[56] References Cited

U.S. PATENT DOCUMENTS

| | | | |
|---|---|---|---|
| 2,594,789 | 4/1952 | Morin | 29/770 X |
| 2,816,648 | 12/1957 | Firing | 83/921 X |
| 3,391,441 | 7/1968 | Carlile | 29/408 |
| 3,490,133 | 1/1970 | Glindmeyer et al. | 29/770 X |
| 3,611,545 | 10/1971 | Takamatsu | 29/408 |
| 3,685,130 | 8/1972 | Doerter | 29/408 |
| 3,812,573 | 5/1974 | Fukuroi | 29/770 X |
| 3,852,869 | 12/1974 | Shimai | 29/408 |
| 3,863,323 | 2/1975 | Takamatsu | 29/408 |
| 3,958,319 | 5/1976 | Takamatsu | 29/410 |

*Primary Examiner*—Ervin M. Combs

*Attorney, Agent, or Firm*—Hill, Van Santen, Steadman, Chiara & Simpson

[57] ABSTRACT

An efficient and reliable means is provided for removing fastener elements or scoops from the tape-edge cords of a slide fastener chain to form the so-called space section without injuring the cords and beads, wherein carrier tape is held between a pair of holder members in a manner such that the ends of the bifurcated leg portions of fastener chain element are in contact with the ends of the holder members; each fastener chain element is cut and divided at the head portion by a wedge-like cutter blade into two pieces with simultaneous opening of the holder members whereby the bifurcated leg portions are outstretched and the scraping of element debris off the carrier tape is facilitated; and the tape-edge cord is withdrawn into between the two holder members before it is contacted by the edge of the downward cutter blade.

5 Claims, 6 Drawing Figures

METHOD AND APPARATUS FOR REMOVING FASTENER ELEMENTS FROM A SLIDE FASTENER CHAIN

BACKGROUND OF THE INVENTION

The present invention relates to a method and apparatus for forming an element-free gap or a so-called space section in a slide fastener chain by removing one or more discrete fastener elements from the carrier tape to which the fastener elements are secured firmly.

It is a usual practice of nowaday manufacturers of slide fasteners that, instead of manufacturing slide fasteners of individual product lengths as such, a continuous length slide fastener chain is first manfactured by securely fastening fastener elements, which have been shaped by die-casting a metal or injection-molding a plastic resin, on to a tape cord reinforcing the longitudinal edge of the carrier tape to form an element row and then several of the fastener elements are removed from the element row at certain intervals to form so-called space sections free of the elements where the slide fastener chain is cut subsequently into the individual desired product lengths. Further, there may often be a necessity to remove several of the fastener elements from a slide fastener of a finished product length to obtain a shortened slide fastener, for example, in tailors and other users as well as in a retailer's shop according to customer's orders to have the slide fastener shortened to match the design or size of clothes or other products to which the slide fastener is to be sewn.

There have heretofore been proposed various methods and related apparatuses for forming space sections in a continuous length slide fastener chain of the above type with the above described purpose. One of the methods known in the art is concerned with cutting the coupling head portions only of the elements off the fastener chain within the desired section and thereafter removing the leg portions of the elements left in clinging to the tape cord off the carrier tape by pulling. Another method comprises the steps of pressing fastener elements within a section as desired into deformed, flattened configuration and thereafter forcibly separating the thus deformed elements from the tape cord. These prior art methods, however, suffer from the drawbacks that the carrier tape or, especially, the tape cord is sometimes injured as well as that the removal of the fastener elements is sometimes incomplete because the methods involve the step of forcible plucking of the deformed elements or element debris from the tape cord.

SUMMARY OF THE INVENTION

It is therefore an object of the present invention to provide a method and an apparatus therefor according to which or with which fastener elements can be removed from a slide fastener chain either of a continuous length or of a unit product length with certainty and without injury of the tape cord of the carrier tape.

According to one aspect of the invention there is provided a method for removing a fastener element from the tape cord of the carrier tape of a slide fastener chain which comprises the steps of (a) holding the carrier tape between a pair of holder members capable of opening and closing in such a manner that the ends of the bifurcated leg portions of the fastener element are in contact with the upper ends of the holder members, (b) thrusting a wedge-like cutter blade into the fastener element at the coupling head portion thereof in the direction toward the tape cord, (c) opening the holder members outwardly whereby the bifurcated leg portions of the fastener element are outstretched by the upper ends of the holder members so that the fastener element is divided into two pieces, (d) withdrawing the tape cord into the gap between the holder members before the edge of the cutter blade reaches the tape cord, and (e) stopping the advancing cutter blade.

According to another aspect of the invention there is provided an apparatus for removing a fastener element from the tape cord of the carrier tape of a slide fastener chain comprising (i) a pair of holder members each being rotatable around a pivotal axis and capable of opening and closing to hold the carrier tape therebetween in such a manner that the ends of the bifurcated leg portions of the fastener element are in contact with the upper ends of the holder members, (ii) a wedge-like cutter blade with an edge facing the holder members and capable of advancing to be thrusted into the coupling head portion of the fastener element toward the tape cord of the slide fastener chain, (iii) means for opening the holder members when the edge of the cutter blade is thrusted into the coupling head portion of the fastener element, and (iv) means for withdrawing the tape cord freed of the fastener element into the gap between the holder members before the edge of the cutter blade reaches the tape cord.

DETAILED DESCRIPTION OF THE PREFERRED EMBODIMENTS

Figure 5:
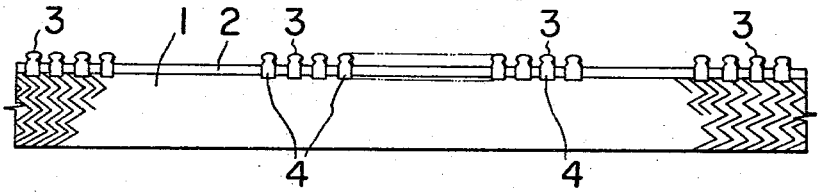
FIG. 5 is a plan view of a slide fastener chain with several of the fastener elements removed within the space sections.

In the drawings, FIG. 5 illustrates a slide fastener chain which has a carrier tape 1 reinforced with a tape cord 2 at a longitudinal periphery thereof and a plurality of fastener elements 3 made of a plastic resin or a metal firmly secured at uniform intervals to the tape cord 2 of the carrier tape 1 at bifurcated leg portions 4 thereof to form an element row, from which several of the fastener elements have been removed in two sections to give the space sections of definite lengths where the slide fastener chain is subsequently cut into slide fastener chains of the individual product lengths.

Figure 6:
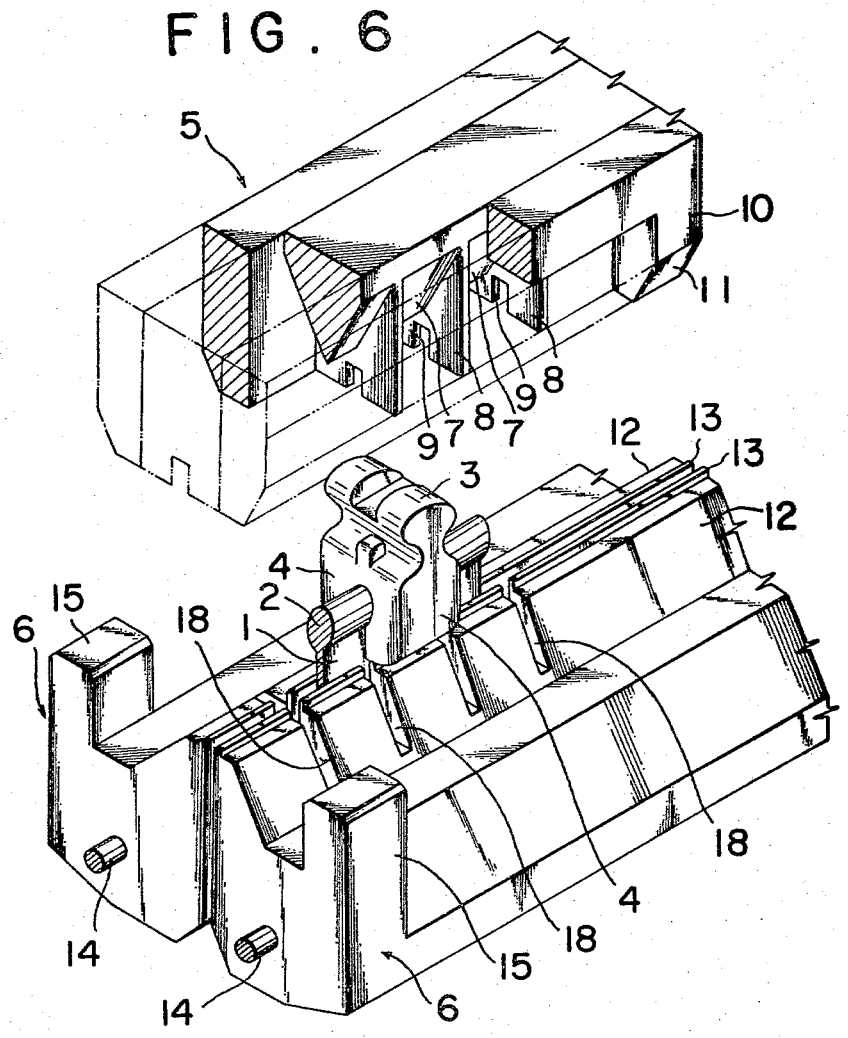
FIG. 6 is a perspective view of the inventive apparatus, shown as partially sectioned.

The structure and the movement of the inventive apparatus for removing fastener elements 3 from the tape cord 2 are now illustrated with reference to FIG. 6, which shows the perspective view of the main part of the apparatus, and FIGS. 1 to 4, which show the successive steps of the movement of the apparatus by way of the cross sectional views of the main part thereof. The main part of the apparatus is composed of a pair of holder members 6 for holding the carrier tape 1 of the slide fastener chain therebetween and a cutter 5 positioned above the holder members 6 and facing them. The cutter 5 is capable of advancing or being retracted, i.e. moving downwardly and upwardly in the figures, with a desired stroke by being driven with a suitable driving means not shown in the figures.

The cutter 5 is provided with a plurality of wedge-like cutter blades 7, which are the same in number and in pitch as the fastener elements 3 to be removed from the tape cord 2 to form a space section. Between each pair of the adjacent cutter blades 7 is provided a respective pusher plate 8 which is also movable in the vertical direction with the cutter blades 7. The lower edge of each pusher plate 8 is provided with a notch 9 fitting the tape cord 2 when the cutter 5 is lowered to come into contact with the tape cord 2, the height of the bottom of the notch 9 being lower than the edge of the cutter blade 7.

On both lateral sides of the cutter blades 7 are provided a pair of outstretchers 10, each of them having one or two downward projections 11 on one or both of its ends each with a tapered surface facing outwardly at the lower corner thereof.

The holder members 6 are capable of opening and closing as each is rotatable around the pivotal axis 14, and, when they are opened to form a gap at the raised portions 12 thereof, the carrier tape 1 of a slide fastener is put into the gap and thereupon the holder members 6 are closed to hold the carrier tape 1 therebetween in such a manner that the upper ends 13 of the raised portions 12 are brought into contact with the lower ends of the leg portions 4 of the fastener elements 3 so that each of the fastener elements 3 is held in its position firmly.

The upper ends 13 of the holder members 6 may be flat surfaces but, preferably, they are provided with line protrusions or indentations in order to increase frictional resistance between the leg portions 4 of the fastener elements and the holder members 6 so as that the leg portions can be held more firmly on the holder members 6. Each of the holder members 6 is provided with one or two receptors 15 protruded upwardly at one or both ends of the holder member 6, facing the projection 11 of the outstretcher 10 so that the receptor 15 and the projection 11 of the outstretcher 10 come into contact with each other at the tapered surface of the latter when the outstretcher 10 is in a lowered position, giving an outward pushing force to the former and providing a means to open the holder members 6 outwardly when the outstretcher 10 is further lowered. A compression spring 16 is provided between each of the holder members 6 and the table 17 of the apparatus, by virtue of which the holder members 6 return automatically to the closed position when the outstretcher 10 is elevated. As is shown in FIG. 6, each of the holder members 6 is provided with slits 18 with the same pitch as the pusher plates 8 between the cutter blades 7.

Following is a description of the movement of the inventive apparatus as described above with which the method of the present invention is practiced for removing fastener elements 3 from the tape cord 2.

Figure 1:
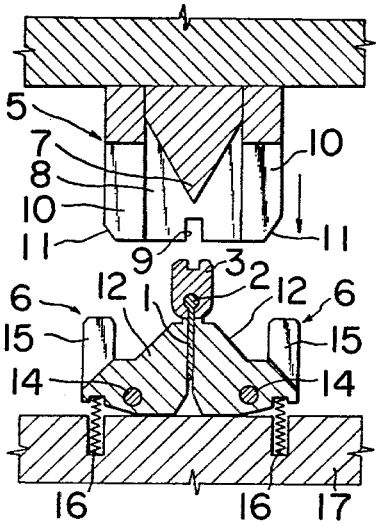
FIGS. 1 to 4 show cross sectional views of the main part of the inventive apparatus in successive steps of the movement.
Figure 2:
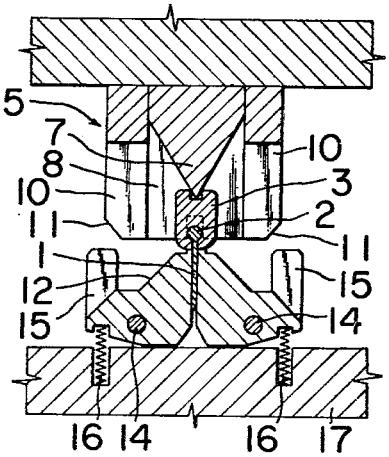

In the first step, the carrier tape 1 of a slide fastener chain is put between the holder members 6 in opened positions and then firmly held by closing the holder members 6 as is shown in FIG. 1 in such a manner that the lower end of each of the bifurcated leg portions of the fastener elements 3 is in contact with the upper end 13 of the sectioned holder member 6. Next step is the lowering of the cutter 5 toward the coupling head portions of the fastener elements 3 to be thrusted into the fastener elements 3 with the individual cutter blades 7 as is shown in FIG. 2. The force applied to the fastener elements 3 is borne by the holder members 6 in contact with the lower ends of the leg portions of the fastener elements 3.

Figure 3:
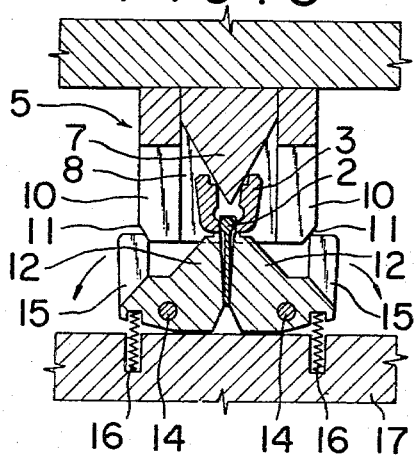

By further downward progress of the cutter 5 as is shown in FIG. 3, the fastener elements 3 are divided each into two pieces, cut by the wedge-like cutter blade 7 penetrating thereto and pushing aside the severed debris of the fastener elements 3.

At the same time as the cutting of the fastener elements 3 with the cutter blades 7, the projections 11 of the outstretchers 10 come into contact with the receptors 15 at the tapered surfaces and thereafter push the receptors 15 outwardly, whereby the holder members 6 are opened as the cutter 5 further descends. Consequently, the leg portions 4 of the fastener elements 3 become subject to the outstretching force exerted by the outward movement of the upper ends 13 of the holder members 6 so as to promote the dividing action of the fastener elements 3 by the descending cutter blades 7 along with the function of scraping off the element debris outwardly from the tape cord 2.

Figure 4:
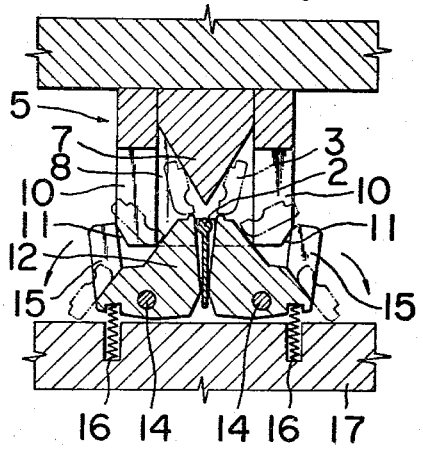

As the cutter blades 7 are lowered beyond completion of cutting the fastener elements 3 at the coupling head portions, the pusher plates 8 between the cutter blades 7 enter the slits 18 in the holder members 6 eventually contacting the tape cord 2 at the notches 9 thereof. With further lowering of the cutter 5, the pusher plates 8 push the tape cord 2 down into the gap between the holder members 6 formed by the opening action of the projections 11 of the outstretchers 10 in contact with the receptors 15 as is shown in FIG. 4. Inasmuch as the pusher plates 8 and the slits 18 are provided with the same pitch, the pusher plates 18 never hit the holder members 6. Furthermore, the tape cord 2 never comes into contact with the cutter blades 7 because the height of the bottom of the notch 9 is lower than the edge of the cutter blade 7 so that damage to the tape cord 2 caused by the cutter blades 7 can be avoided with certainty.

As may be understood from the above description, the removal of the fastener elements 3 from the tape cord 2 is very reliable due to the synergistic effects given by the wedging of the cutter blades 7 into the head portions of the fastener elements 3, aided by the outstretching at the bifurcated leg portions 4 with the opening movement of the holder members 6 so that the severed element debris is very smoothly scraped off the tape cord 2 with no danger at all of injury caused by hooking at the pointed corners of the fastener elements 3. In addition, the tape cord 2 is withdrawn between the holder members 6, pushed by the pusher plates 8 before the downward movement of the cutter 5 is stopped without reaching the tape cord 2 at the edges of the cutter blades 7, resulting in perfect protection of the tape cord 2 from injury by contacting with the cutter blades 7. Thus the advantages obtained by the present invention are efficiency and reliability in the removal of the fastener elements from the tape cord as well as the possibility of presenting slide fastener chains of beautiful appearance with space sections being free from any injury in the tape cord which is often unavoidable in the prior art.

I claim:

1. A method for removing a fastener element from a tape cord of a carrier tape of a slide fastener chain which comprises the steps of (a) holding the carrier tape between a pair of holder members capable of opening and closing in such a manner that ends of bifurcated leg portions of the fastener element are in contact with upper ends of said pair of the holder members, (b) thrusting a wedge-like cutter blade into the fastener element at a coupling head portion thereof in a direction toward the tape cord, (c) opening the holder members outwardly to outwardly deform the bifurcated leg portions of the fastener element by means of the upper ends of the holder members, to divide the fastener element into two pieces, and to separate said pieces from the tape cord, (d) withdrawing the tape cord separated from the fastener element into a gap between the holder members before said edge of the cutter blade reaches said tape cord, and (e) stopping the advancing of said cutter blade.

2. An apparatus for removing a fastener element from a tape cord of a carrier tape of a slide fastener chain comprising (i) a pair of holder members each being rotatable around a pivotal axis and capable of opening and closing to hold the carrier tape therebetween in such a manner that ends of bifurcated leg portions of the fastener element are in contact with upper ends of the holder members, (ii) a wedge-like cutter blade with an edge facing the holder members and mounted for movement to be thrusted into a coupling head portion of the fastener element in a direction toward the said tape cord of the slide fastener chain, (iii) means for opening the holder members outwardly when the edge of said cutter blade is thrusted into said coupling head portion of the fastener element, to outwardly deform the bifurcated leg portions of the fastener element, to divide the element into two pieces, and to separate said pieces from the tape cord, and (iv) means for withdrawing the tape cord separated from the fastener element into a gap between the holder members before said edge of the cutter blade reaches said tape cord.

3. The apparatus as claimed in claim 2 wherein the means for opening the holder members comprises a projection with a tapered surface facing outwardly, said projection being moveable together with the cutter blade, and a receptor fixed to the holder member for contacting the projection at said tapered surface for pushing said holder members outwardly for rotation around a pivotal axis to form said gap therebetween when the cutter blade advances toward the tape cord.

4. The apparatus as claimed in claim 2 wherein the means for withdrawing the tape cord comprises a pusher plate positioned between a pair of adjacent cutter blades, said pusher plate being moveable together with the cutter blades, and having a notch on an edge thereof, a bottom portion of the notch being in an advanced position relative to the edge of each cutter blade and coming into contact with the tape cord when the cutter blades advance toward the tape cord.

5. The apparatus as claimed in claim 4 wherein the holder member is provided with a slit, and the pusher plate enters the slit when the cutter blades advance toward the tape cord.

* * * * *